United States Patent [19]

Kawamura et al.

[11] Patent Number: 4,817,466

[45] Date of Patent: Apr. 4, 1989

[54] REMOTE CONTROL SYSTEM FOR MARINE ENGINE

[75] Inventors: Minoru Kawamura; Seiji Inoue, both of Hamamatsu, Japan

[73] Assignee: Sanshin Kogyo Kabushiki Kaisha, Hamamatsu, Japan

[21] Appl. No.: 930,716

[22] Filed: Nov. 13, 1986

[30] Foreign Application Priority Data

Nov. 14, 1985 [JP] Japan ..... 60-255557

[51] Int. Cl.[4] ..... B60K 41/06

[52] U.S. Cl. ..... 74/858; 74/872; 74/875; 440/75

[58] Field of Search ..... 440/1, 75; 74/858, 872, 74/875, DIG. 2, DIG. 8

[56] References Cited

U.S. PATENT DOCUMENTS

| | | | |
|---|---|---|---|
| 3,667,577 | 6/1972 | Weymann | 74/858 X |
| 3,669,234 | 6/1972 | Mathers | 74/858 X |
| 3,814,224 | 6/1974 | Podssuweit et al. | 74/858 X |
| 4,458,799 | 7/1984 | Schueller | 440/75 X |
| 4,683,773 | 8/1987 | Pfalzgraf | 74/858 |
| 4,726,798 | 2/1988 | Davis | 440/75 |
| 4,739,236 | 4/1988 | Burkenpas | 440/1 |

FOREIGN PATENT DOCUMENTS

| | | | |
|---|---|---|---|
| 1352340 | 1/1964 | France | 440/75 |

*Primary Examiner*—Dwight G. Diehl
*Attorney, Agent, or Firm*—Ernest A. Beutler

[57] ABSTRACT

A remote control system for a watercraft having a remotely positioned control device and a plurality of control device for operating the engine speed, transmission control and starter. The means for transmitting the signal from the control device to the controlled devices includes a computer that is programmed for moving the throttle of the engine to neutral when a shift is being made and for limiting the speed of the engine in reverse. In addition, and emergency deceleration device is provided for rapidly closing the throttle and shifting the transmission into the opposite direction for emergency deceleration. An improved starter arrangement is incorporated wherein the transmission is moved to neutral upon initiation of a starting sequence and the started is cranked for only a predetermined time interval to prevent overheating.

19 Claims, 13 Drawing Sheets

START
130
X=0
NO
YES
131
S1-S3 ON?
YES
NO
132
S10, S11 ON?
YES
INITIATE SHIFT PROGRAM
133
S10 ON?
NO
YES
134
S8 ON?
YES
ORDER TILT/ TRIM DOWN
INITIATE STARTING
XS→0
135
ORDER TILT/ TRIM UP
136
S4-S7 ON?
NO
S4 ON
S5 ON
S6 ON
S7 ON
137
Q=0?
YES
NO
138
IS TV AT IDLE?
YES
NO
142
ACCL/ DEC. PROGRAM 2
144
ACCL/ DEC. PROGRAM 4
141
ACCL/ DEC. PROGRAM 1
143
ACCL/ DEC. PROGRAM 3
139
CLOSE TV
140
Q→0
Q→0
Q→0
Q→0
EXIT

REMOTE CONTROL SYSTEM FOR MARINE ENGINE

BACKGROUND OF THE INVENTION

This invention relates to a remote control system for marine engines and more particularly to an improved system for remotely controlling the power unit of a marine watercraft.

In the copending application entitled "A Remote Control System For Marine Engines", Ser. No. 818,799, filed Jan. 14, 1986 in the name of Minoru Kawamura, and assigned to the assignee of this application which application has been refiled as application Ser. No. 129,851 on Dec. 7, 1987 still pending, there is depicted a remote control system for transmitting signals from a control device to a plurality of controlled devices for operating a marine propulsion unit. That system employs fiber optics for transmitting the control signals so as to reduce the likelihood of interference from noise and/or false signals due to water entering the transmitters. This invention relates to an improvement in that type of system.

In marine propulsion of this type, it is desirable to provide remote controls for both the speed and the transmission of the power unit. However, these two controls cannot be operated completely independently of each other. That is, in order to protect the transmission, it is desirable that the engine be returned to an idle or slow speed condition upon shifting. Although the operator may be called upon to perform this function, it is desirable if the speed can be automatically reduced upon shifting.

It is, therefore, a principal object of this invention to provide an improved remote control unit for a marine propulsion unit wherein the transmission and throttle controls are automatically interrelated.

It is a further object of this invention to provide an engine speed and transmission control from a remote operator wherein the engine speed is automatically reduced upon shifting.

In watercraft that have both forward and reverse transmission ratios, it is desirable to insure that the speed of the engine does not exceed a predetermined speed when operating in reverse gear. It is particularly desirable if such speed limitation can be accomplished automatically.

It is, therefore, a still further object of this invention to provide a remote operator for an engine speed and transmission control wherein the engine speed is automatically limited when the transmission is in reverse.

In watercraft, it is desirable to provide an arrangement for rapidly decelerating the watercraft in emergency conditions. Obviously, a watercraft does not have a brake system as such and thus it is common practice to use the propulsion device as a braking unit. In connection with this, under emergency braking conditions, it is desirable to be able to shift the transmission into an opposite direction for assisting braking. However, this type of braking is only required under certain conditions and under certain watercraft speed.

It is, therefore, a further object of this invention to provide an improved remote control unit for a watercraft that embodies an emergency deceleration system.

It is a further object of this invention to provide an emergency deceleration system for watercraft wherein the transmission is automatically shifted into the opposite direction under an emergency deceleration command.

It is a further object of the invention to provide a remote control system for a watercraft wherein the speed of the watercraft can be reduced under emergency conditions either by slowing the engine or shifting the transmission into the opposite direction depending upon the speed of travel.

In connection with remote controls of the type aforedescribed, it is obviously desirable to provide an arrangement for permitting remote starting of the engine. However, it is also desirable to insure that the starter motor is not cranked for long periods of time to prevent damage by overheating.

It is, therefore, a still further object of this invention to provide an improved remote starting arrangement for a watercraft.

It is yet another object of this invention to provide a watercraft starting system wherein the starter is only cranked for a limited period of time regardless of the operator's input.

SUMMARY OF THE INVENTION

A first feature of the invention is adapted to be embodied in a remote control system for a watercraft that has a propulsion unit comprised of an engine having an engine speed control and a transmission having at least a forward gear and a neutral. A first power means is provided for moving the engine speed control between an idle position, a part throttle position and a full throttle position. Second power means are provided for moving the transmission between its forward gear and the neutral condition. A remote control device is provided for actuating the first and second power means and means including computer means are incorporated for transmitting signals between the remote control device to the first and second power means. The computer means includes logic for precluding operation of the second power means to effect a shift unless the engine speed is below a predetermined value.

Another feature of the invention is adapted to be embodied in a remote control system for a watercraft having a propulsion unit and a transmission as set forth in the preceding paragraph. In connection with this feature of the invention, the transmission also has a reverse gear and the computer means includes means for limiting the speed of the engine in at least one gear of the transmission.

A still further feature of the invention is adapted to be embodied in a remote control system for a watercraft as set forth in the preceding two paragraphs. In accordance with this feature of the invention, an emergency deceleration system is provided which slows the speed of the watercraft by selectively reducing the speed of the engine at a rapid rate and/or by shifting the transmission into an opposite direction.

A still further feature of the invention is adapted to be embodied in a remote control system for a watercraft having a propulsion unit comprised of an engine with a starter. In accordance with this feature of the invention, a remote control device is provided for actuating the starter and signals are transmitted from the remove control device to the starter by means including a computer that has a logic for operating the starter only for a limited period of time upon the initiation of a starting signal.

DETAILED DESCRIPTION OF THE PREFERRED EMBODIMENT

The invention is particularly adapted to be embodied in a remote control arrangement for controlling the propulsion unit of a watercraft. The overall construction of the watercraft and some details of the construction of the control element and controlled element may be understood by reference to aforenoted U.S. patent application Ser. No. 818,799, which is incorporated herein by reference. Basically, the watercraft includes a power unit such as an internal combustion engine which drives a propeller or other propulsion of the unit of the watercraft through a forward, neutral, reverse transmission. The power unit may be an outboard motor, an inboard-outboard drive or an inboard drive of any type. Since these basic components of the watercraft including the power unit and the construction of the watercraft itself form no portion of the invention, only those components which are necessary to understand the construction and operation of the invention have been illustrated and will be described.

Figure 1:
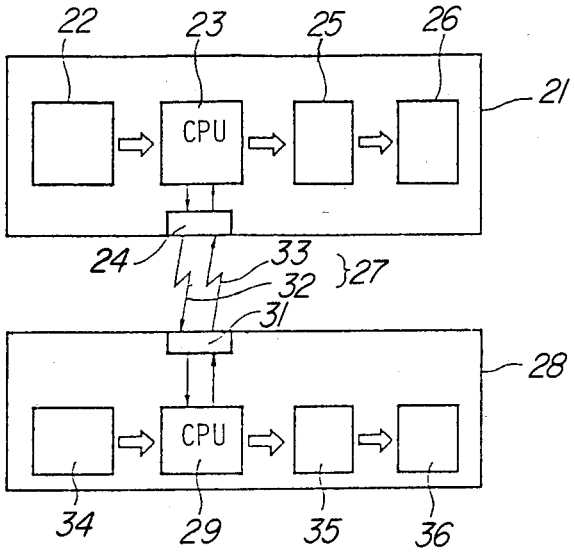
FIG. 1 is a schematic view showing the construction of the control element and controlled element and the relationship therebetween in accordance with an embodiment of the invention.
Figure 2:
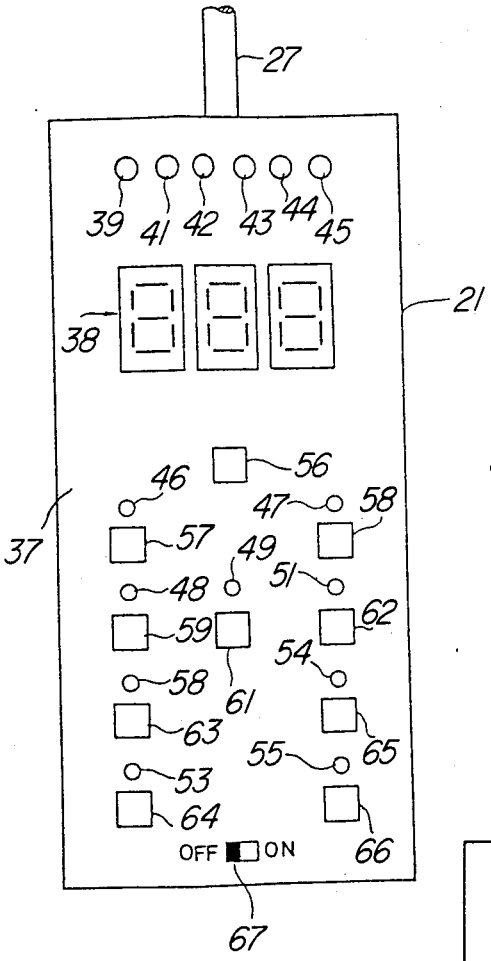
FIG. 2 is an elevational view on an enlarged scale showing the control element.

Referring first primarily to FIGS. 1 and 2, the control system includes a controlling element, indicated generally by the reference numeral 21 and which is relatively compact but which affords a number of individual controls for the propulsion unit of the associated watercraft and also provides the operator with a number of visual indications as to the propulsion unit's operational mode and status. The controlling device 21 includes a control input part 22 that includes a number of operator controls, as will become more apparent by reference to FIG. 2, which input a signal to a central processing unit (CPU) 23. The central processing unit 23 receives and processes signals and outputs these signals to a photoelectric conversion unit 24. In addition, certain of the output signals are transmitted to a display driving circuit 25 which, in turn, operates a visual display 26.

An optical fiber cable, indicated generally by the reference numeral 27, is incorporated for transmitting signals between the control device 21 and a controlled device, indicated generally by the reference numeral 28. These signals are transmitted to a central processing unit (CPU) 29 of the controlled device 28 via the optical fiber cable 27 and a photoelectric conversion device 31 that converts optical signals to electrical signals and vice versa. Signals are transmitted from the CPU 33 to the CPU 29 over an optical transmitter, indicated by the reference numeral 32, while signals in the opposite direction are transmitted by an optical transmitter 33. The transmitters 32 and 33 together make up the cable 27. A plurality of individual signals may be transmitted over the individual transmitters 32 and 33 by means of a suitable multiplexing arrangement. This transmission avoids noise or false signals as might occur if wire conductors were to be used.

Figure 6:
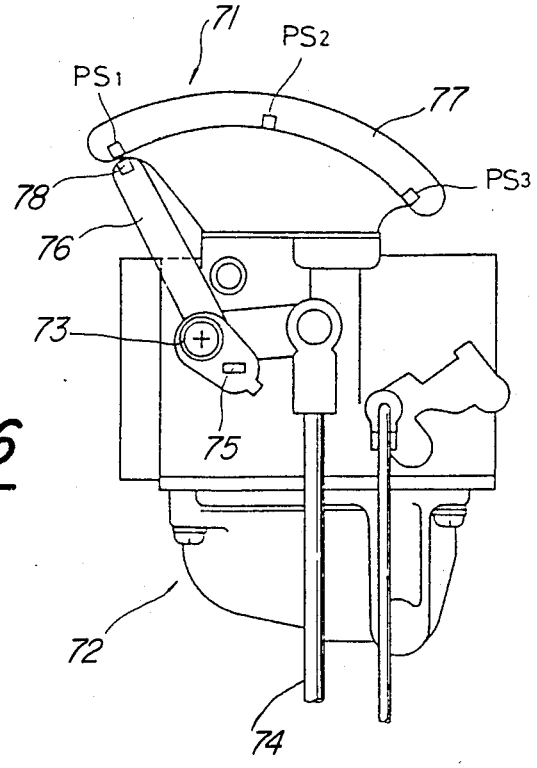
FIG. 6 is a side elevational view of the carburetor of the associated watercraft power unit and illustrates the throttle position indicating mechanism.
Figure 7:
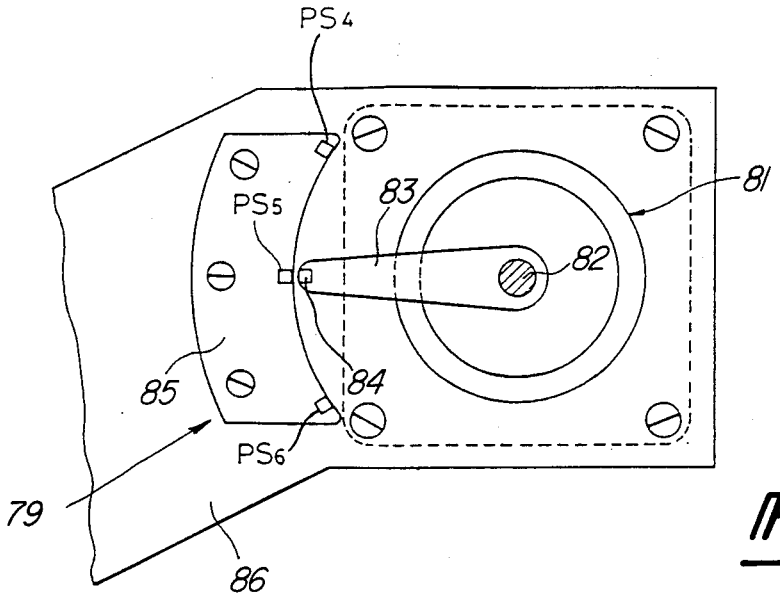
FIG. 7 is a top plan view of the transmission control mechanism of the associated watercraft and illustrates the transmission selector indicator mechanism.
Figure 8:
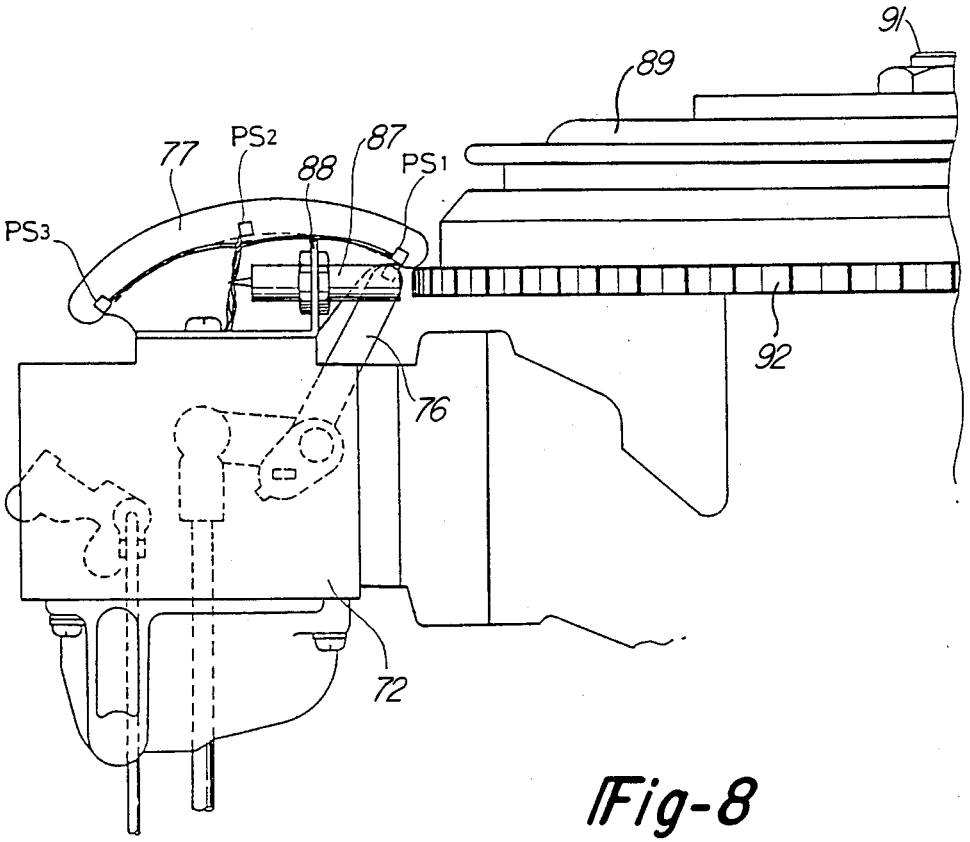
FIG. 8 is a side elevational view of a portion of the watercraft engine showing the engine speed sensing mechanism.

In addition to receiving and transmitting signals from the CPU 23, the CPU 29 receives signals from a plurality of propulsion unit sensing devices, indicated schematically by the block 34 and certain of which are shown in FIGS. 6 through 8. In addition, the CPU 29 outputs signals to an actuating circuit 35 which drives a plurality of actuators, indicated generally by the box 36, to provide actuating signals to the units of the propulsion unit, as will become apparent. It should be understood that the functions performed by the CPU 23 and the CPU 29 may be exchanged between either of these CPUs without departing from the invention. That is, if a single signal processing function is described as being performed by the CPU 23, in most instances this same processing function may alternatively be accomplished by the CPU 29 and vice versa.

Referring now primarily to FIG. 2, the control device 21 includes a face panel 37 on which a number of displays are positioned. These displays include an engine speed display 38 which may conveniently comprise a plurality of liquid crystal devices so as to provide an indication of engine speed in thousands, hundreds and tens of revolutions per minute. In addition, a plurality of light emitting diodes 39, 41, 42, 43, 44, 45, 46, 47, 48, 49, 51, 52, 53, 54 and 55 are carried on the panel 37 for displaying various types of information. The type of information displayed by the LEDs 39, 41 through 49 and 51 through 55 may vary with the application. Typically, however, the indicators may be as follows:

39—electrical power on

41—kill switch on

42—control element defect
43—engine over-speed
44—engine over-temperature
45—oil level low
46—forward acceleration
47—rearward acceleration
48—transmission in forward
49—transmission in neutral
51—transmission in reverse
52—starter motor operating
53—choke on
54—trim or tilt up
55—trim or tilt down In addition to the indicators already mentioned, the panel 37 also supports a number of switches for effecting certain controls of the power unit operation. Preferably, these switches are located in close proximity to the appropriate indicators, already indicated. These switches may comprise capacitive, mechanical switches or any known type of switches and consist of the following:

56—kill switch
57—forward acceleration
58—rearward acceleration
59—transmission forward select switch
61—transmission neutral select switch
62—transmission reverse select switch
63—start switch
64—choke switch
65—trim-tilt up control switch
66—trim-tilt down switch The acceleration switches 57 and 58 control both throttle opening as well as transmission shifting through four acceleration/deceleration programs to be described. A light pressure will affect a slow acceleration or deceleration while a heavier pressure will effect a more rapid or emergency acceleration or deceleration. When the boat is in forward gear, the switch 57 will control acceleration while the switch 58 will control deceleration. When the boat is in reverse, the switch 58 will control acceleration and the switch 57 will control deceleration. The switches 57 and 58 output a signal only when they are depressed. Like the acceleration/deceleration control switches 57 and 58, the starter switch 63, and tilt up and tilt down switches 65 and 66 operate to output a signal only so long as they are depressed. The kill switch 56, forward transmission select switch 59, neutral transmission select switch 61 and reverse transmission select switch 62, all maintain their state once they are depressed. The choke switch 64 is operated so that it has a change of state each time it is depressed. Hence, the first depression of the switch 64 will turn the choke on and the next depression of it will turn the choke off.

In addition to these switches already described, there is provided a master switch 67 which turns on and off the power to the unit.

Figure 4:
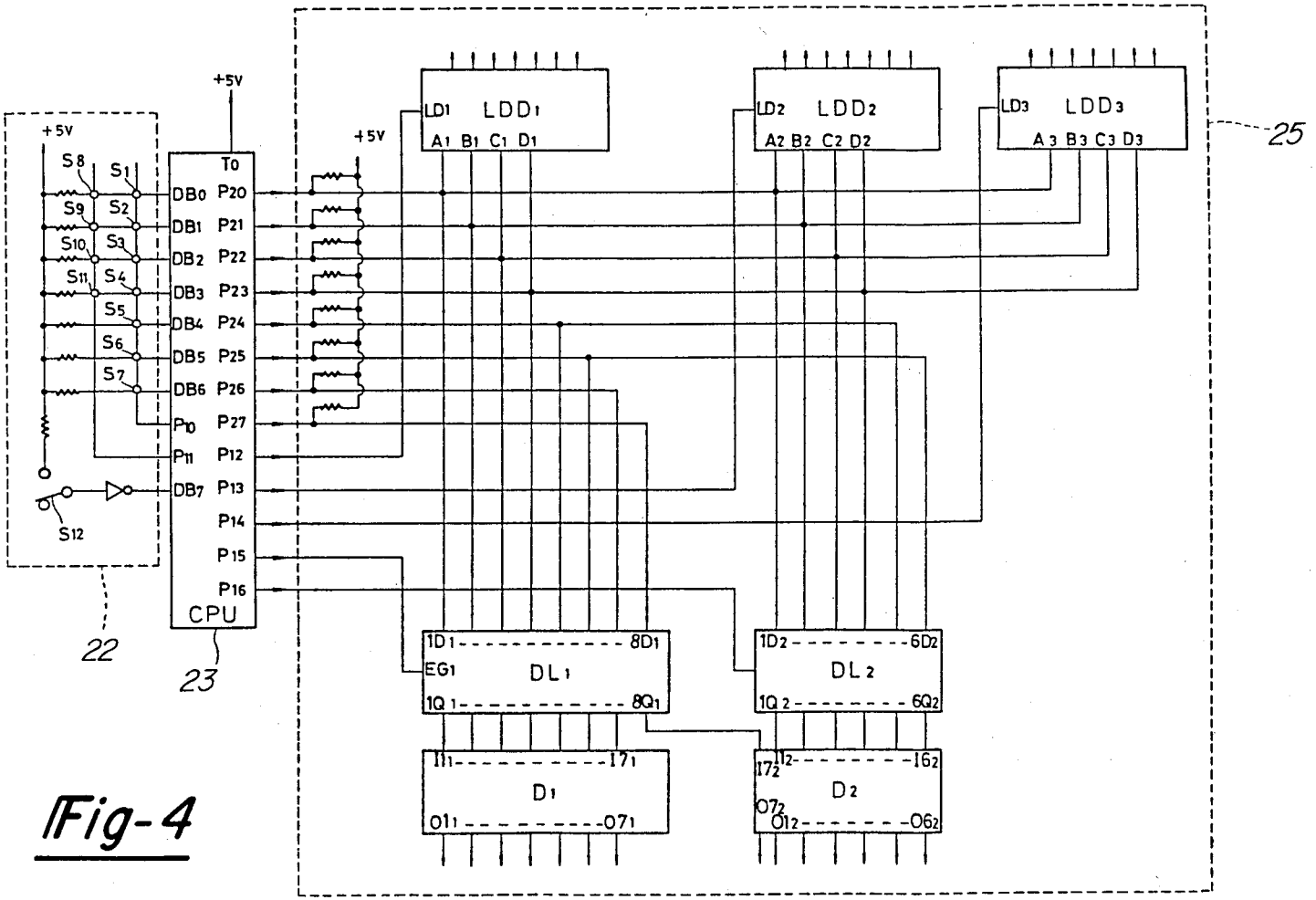
FIG. 4 is a schematic showing the relationship and construction of certain components of the control element.

FIG. 4 is a circuit diagram of the main part of the controlling device 21. In this device, the input unit 22 includes a series of switches S1 to S12, inclusive, that correspond to selected ones of the switches illustrated in FIG. 2, as follows:

S1=59=forward gear
S2=61=neutral
S3=62=reverse gear
S4—57 soft=acceleration/deceleration program 1
S5=57 hard=acceleration/deceleration program 2
S6=58 soft=acceleration/deceleration program 3
S7=58 hard=acceleration/deceleration program 4
S8=63=start
S9=64=choke
S10=65=tilt-trim up
S11=65=tilt-trim down
S12=56=kill It will be noted that the switches S1 through S7, inclusive, are in direct circuit with input ports DB0 through DB6 inclusive of the CPU 23. the switches S1 through S7 are also in series relationship with an input port P10 of the CPU 23. The switches S8 through S11 are in series connection with the switches S1 through S4, respectively, and accordingly the ports DB0 through DB3, respectively. The switches S8 through S11 are also in series connection with an input port P11 of the CPU 23. The switches are related so that when they are off, they have an output of 1 and when they are on, they have an output of 0. In this way, the ports DB0 through DB6 and P10 and P11 may act in concert to determine the status of the individual switches. That is, if the output pulse P11 maintains at 1 and the output pulse of P10 goes to 0, which of the switches S1 through S7 has been turned on can be determined by the state of the ports DB0 through DB6. The manner in which the status of each of these switches S1 through S11 may be determined is believed to be clear to those skilled in this art. It should be noted that the multiplexing is such that the output of the ports P10 and P11 are at a different phase from each other so as to permit this determination of the state of the switches S1 through S11.

The kill switch S12 is directly connected to the input port DB7 of the CPU 23.

In addition to the information comprising the state of these switches S1 through S12, the CPU 23 receives other information such as overheating, overspeed, oil level low, and other appropriate information regarding abnormal operating states, information on the position of the throttle actuator and shift positioner and also information as to whether or not the CPUs 23 and 29 are operational and outputs these signals to respective of the output ports P20 through P27. The outputs from the ports P20 through P27 are transmitted to input terminals 1D1 through 8D1 of DL1. When these signals are outputted, the port P15 of the CPU 23 outputs a signal as a short pulse to change the input of a terminal EG1 of DL1 from 0 to 1 and then back to zero. When EG1 is 1, inputs of the input terminals 1D1 to 8D1 are indicated directly on the output terminals 1Q1 through 8Q1 of DL1. When the state of EG1 returns to 0, the signals at 1D1 through 8D1 previously displayed are immediately memorized until EG1 becomes 1 again.

The outputs 1Q1 through 7Q1 of DL1 are supplied to input terminals I11 through I71 of D1, a seven circuit driver IC where they are transformed to output signal at O11 through O71 for illuminating certain of the aforenoted LEDs. At the same time, the signal from 8Q1 is transmitted to a terminal 172 of D2 for amplification and output at O72 to illuminate an appropriate LED. These LEDs constitute the displays on the panel 21. In the multiplexing operation and at the next point in time, other operating state information is output from the output ports P20 through P25 of the CPU. Then a short pulse is outputted from P16 during the point in time and a signal for actuating the necessary light emitting diodes is output in a similar manner.

LDD1 through LDD3 denote driving circuits for the liquid crystals 38 for indicating the numerical values in thousands, hundreds and tens of engine revolutions per minute, respectively. The numerical values of each unit are output in sequence from the output ports P20 through P27 as a BCD code (expressed by binary with 1 digit of decimal as one unit). Then when the thousand unit level is output, a short pulse is produced at the output port P12 to change the state of LD1 of LDD1 from 0→1→0. Signals of the input terminals Al through D1 of LDD1 are not accepted while LD1 is 0 but are accepted when LD1 changes its state to 1. Then when LD1 changes its state from 1 back to 0, the information of A1 through D1 immediately before is memorized and retained while LD1 is 0. Furthermore, LDD1 interprets the loaded BCD code and converts it into a display signal of a numerical module in 7 elements, amplifies the signal to drive the liquid crystal element directly and outputs a signal for driving directly the thousand unit, 7 element liquid crystal module.

In a similar manner, the hundred unit is outputted from P20 to P23 and is input to the driver LDD2 which receives a triggering pulse from the output port P13 to change the state of LD2 and provide the hundred unit display in a similar manner. A similar squence takes place with the 10 unit display drive by LDD3.

Figure 3:
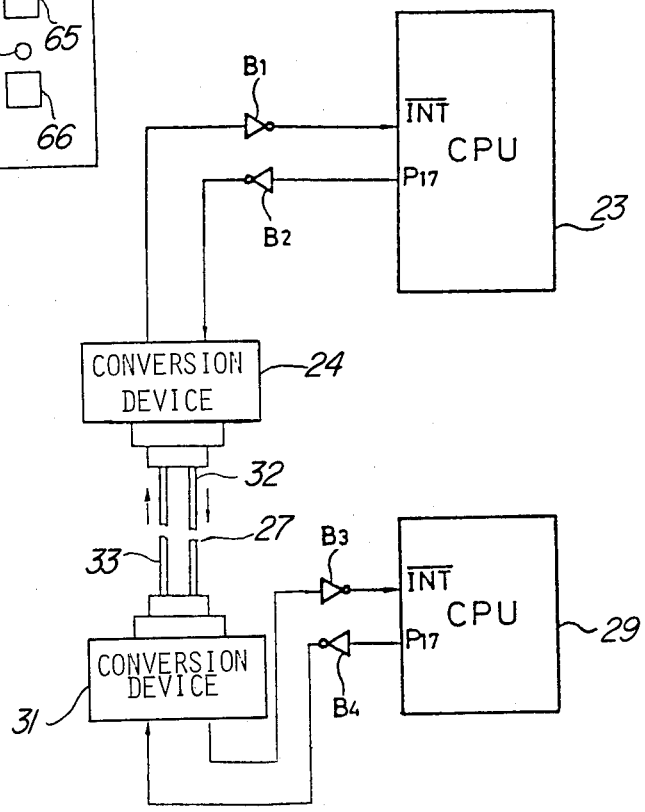
FIG. 3 is a schematic view showing how the signals are transmitted between the CPUs of the control element and the controlled element via optical fibers.

FIG. 3 shows in detail how the CPUs 23 and 29 are interrelated and how signals are transmitted between them by the optical cable 27 including the optical fibers 32 and 33. As has been previously noted, the units 24 and 31 are electrical to optical converters and include means for affording a detachable connection to the optical cable 23. The optical to electrical converters 24 and 23 may be of any known type, for example, those of the type using a light emitting diode and a photodiode. However, other similar devices such as semiconductor lasers and phototransistors may be utilized for this purpose. A communication serial output is transmitted from an output P17 of the CPU 23 to an amplifier B2 to amplify the signal to drive the light emitting diode of the photoelectric conversion unit 24. This signal is transmitted through the optical fiber 32 to the conversion unit 31 that outputs a signal to an amplifier B3 which, in turn, outputs its signal to an interrupt terminal INT of the CPU 29. Signals are transmitted from a serial output port P17 of the CPU 29 to an amplifier B4 for driving the light emitting diode of the conversion unit 31. The optical signals are then transmitted through the optical fiber 33 to the conversion unit 24 where an output signal is amplified by an amplifier B1 and delivered to an interrupt terminal INT of the CPU 23.

Figure 5:
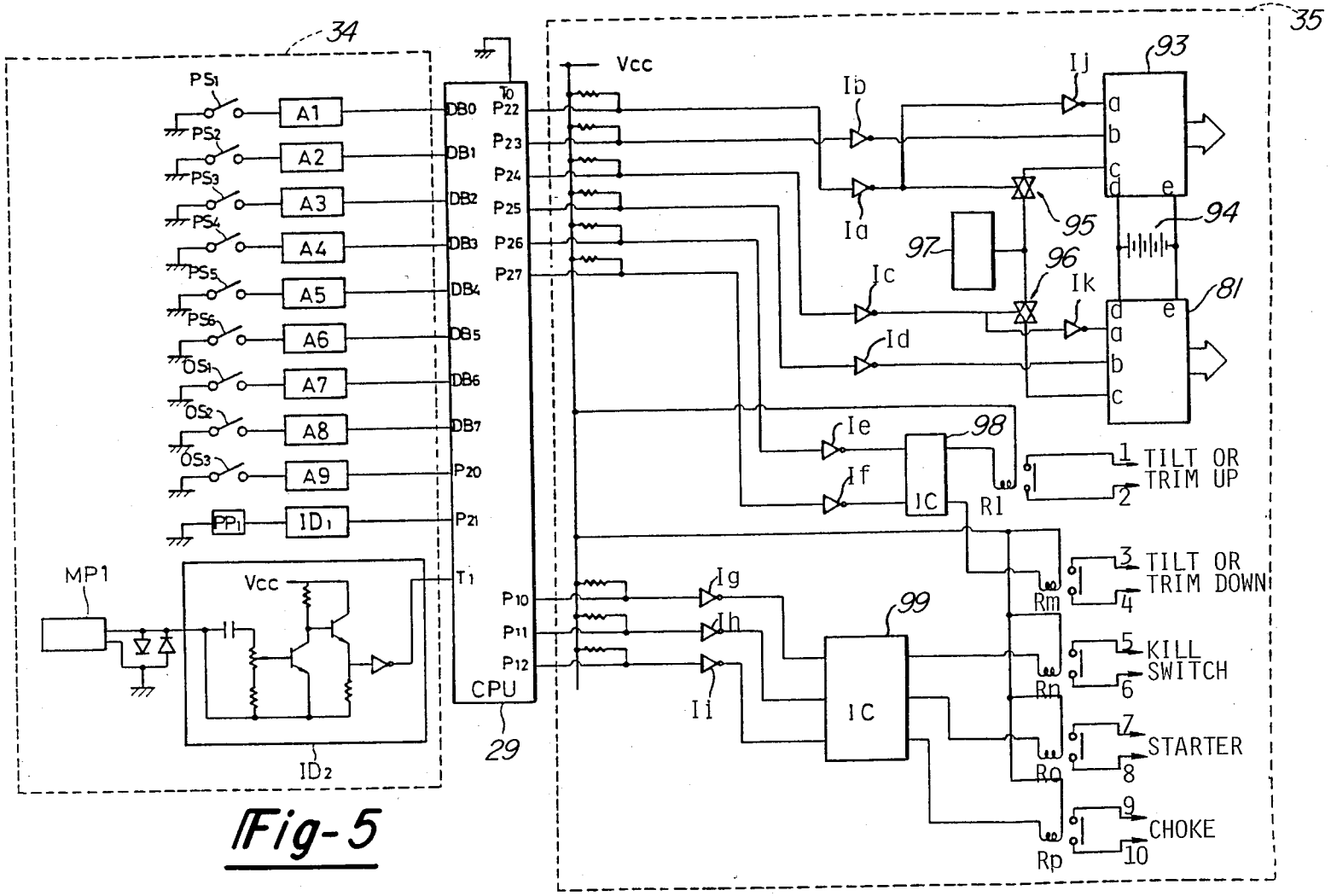
FIG. 5 is a schematic showing the relationship and construction of certain elements of the controlled element.

Referring now to FIG. 5, this figure illustrates the schematics of the relevant portions of the controlled element 28. This element and specifically its sensing portion 34 includes a plurality of remote position sensing switches PS1 through PS6 and a plurality of remote condition sensing elements OS1 through OS3. In addition, there is provided a remote watercraft speed sensing unit PP1. Although various types of sensors may be employed depending upon the desired result, in the illustrated embodiment, the sensors are as follows:

PS1=throttle position sensor-idle
PS2=throttle position sensor-part throttle
PS3=throttle position sensor-full throttle
PS4=transmission condition sensor-forward
PS5=transmission condition sensor-neutral
PS6=transmission condition sensor-reverse
OS1=engine overheat sensor
OS2=engine overspeed sensor
OS3=oil level low sensor
PP1=ship speed sensor The outputs of the sensors PS1 through PS6 and OS1 through OS3 are transmitted to suitable wave form shaping circuits indicated by the blocks A1 through A9, respectively. The output signals from the wave shaping sensors A1 through A9 are delivered to respective input ports DB0 through DB7 and P20, respectively, of the CPU 29. The ship speed sensor PP1 outputs its signal to an analog to digital converter ID1. The output from the analog to digital converter ID1 is delivered through an input port P21 of the CPU 29.

The throttle position sensors PS1 through PS3 are associated with the throttle mechanism and will be described in more detail by reference to FIGS. 6 and 8. The shift position sensors PS4 through PS6 are associated with the transmission control mechanism and will be described in more detail by reference to FIG. 7.

The overheat sensor OS1 may be a thermostatic switch mounted in the cooling jacket of the cylinder head and is switched on when the cylinder head is heated to a predetermined temperature or higher. The engine overspeed sensor OS2 senses when the engine speed exceeds a predetermined speed and comprises a circuit for grounding the pulse circuit of a CD ignition system at the time of over-revolution so as to prevent engine damage. Thus this sensor is depicted as a switch which completes a circuit to ground at the time of over-revolution. In a similar manner, the low oil level switch OS3 determines when the level of oil in either the crankcase or an oil supply tank (depending on the type of engine and lubrication system used) falls below a predetermined level and may be a float operated switch. Of course, as has been previously noted, other types of indicators and switches may be employed depending upon the specific application.

There is further provided in the sensing unit 34 an arrangement for measuring actual engine speed and this mechanism will be described in more detail by reference to FIG. 8. However, this engine speed indicator comprises an electromagnetic pickup MP1 for detecting pulses in proportion to the engine speed. The pulses from the sensor MP1 are delivered to a wave form shaping circuit ID2 that outputs a signal to an input port T1 of the CPU 29.

Referring now to FIG. 6, the throttle position sensing mechanism will be described in detail. This throttle sensing mechanism is indicated generally by the reference numeral 71 and is associated with a charge former in the form of a carburetor 72 for the associated engine of the power unit. The carburetor 72 has its speed controlled by means of a throttle valve (not shown) that is affixed to a throttle valve shaft 73 and which is operated by a suitable throttle link 74. A lever 75 is affixed to the throttle valve shaft 73 for rotation with it and carries a wiper arm 76 which is constructed from a suitable insulating material and which is juxtaposed to an insulated, arcuate switch holder 77 that is carried by the body of the carburetor 72 in an appropriate manner.

A small permanent magnet 78 is carried by the outer end of the wiper arm 76 and is adapted to be brought into proximity with the throttle position switches PS1, PS2 and PS3 when the throttle valve associated with the throttle valve shaft 73 is either in its idle position, part throttle position or wide open throttle position, respectively. The switches PS1, PS2 and PS3 are contactless magnetic switches which will provide an input signal to the respective input ports DB0, DB1 and DB2 of the CPU 29 (FIG. 5) when the magnet 78 is in proximity to them.

A transmission shift condition sensor, indicated generally by the reference numeral 79 and shown in detail in FIG. 7, operates in a generally similar manner. The transmission shift sensor 79 is associated with the transmission control mechanism which may comprise a stepping motor 81 that drives the transmission shift mechanism in a suitable manner. This may comprise a shift rod that is affixed to the lower end of a shaft 82 of the stepping motor 81 and which operates the transmission in a known manner. Affixed to one end of the shaft 82 is an insulated wiper arm 83 that carries a small permanent magnet 84 at its outer end. An insulated switch carrier 85 is mounted on a supporting bracket 86, which supports the stepping motor 81, which is juxtaposed to the wiper arm 83. The bracket 85 carries the switches PS4, PS5 and PS6 in locations corresponding to the forward, neutral and reverse positions, respectively, of the wiper arm 83 and associated transmission. The switches PS4, PS5 and PS6 are of the magnetic, contactless type and will output signals when the magnet 84 is in proximity to them. These signals, as has been previously noted, are outputted respectively to the input ports DB3, DB4 and DB5 of the CPU 29 (FIG. 5).

Referring now to FIG. 8, the electromagnetic pickup MP1 of the engine speed sensor is identified by the refernce numeral 87 and is depicted as being mounted on a supporting bracket 88 that is affixed to the carburetor 72 and which is in proximity to a flywheel 89 that is affixed for rotation with a vertically extending output shaft 91 of the watercraft engine. The flywheel 89 has a starter gear 92, the teeth of which generate pulses as they pass the sensor 87 to generate pulses indicative of the speed of rotation of the shaft 91. As has been previously noted, these pulses are transmitted into a signal by the wave shape forming circuit ID2 and are inputted to the input port T1 of the CPU 29 (FIG. 5). The number of pulses generated will be equal to the number of teeth on the starter gear 92 and if the number of teeth is 100, the engine speed can be computed directly in RPM by measuring the number of pulses generated in 600 milliseconds.

Referring now again to FIG. 5, the actuator portion 35 of the controlled element 28 will be described in detail. The CPU 29 has output ports P22 through P27 that are connected respectively to inverters Ia through If of the actuator part 35. In addition, the CPU has output ports P10 through P11 that are connected, respectively, to inverters Ig through Ii of the actuator part 35.

The ports P22 and P23 are utilized to control a stepping motor 93 that is associated with the throttle control mechanism. Specifically, the stepping motor 93 is connected to the throttle actuating lever 74 for operating the throttle of the carburetor 72 in the opening or closing directions (FIG. 6). The output ports P24 and P25 of the CPU 29 control the stepping motor 81 of the transmission shift mechanism (FIG. 7).

The stepping motors 93 and 81 are supplied with power from a suitable power source, indicated schematically at 94. In the controls for the stepping motors 93 and 81, there are provided a pair of two-way switches 95 and 96 that control the delivery of power to the stepping motors 93 and 81, in a manner to be described. A stepping motor pulse generating circuit 97 is provided for controlling the two-way switches 95 and 96.

Although such a stepping motor pulse generator circuit is described in the illustrated embodiment, it should be understood that the driving pulse can be extracted directly from the CPU 29 or can be achieved in another way. Any circuit will be satisfactory for the pulse generating circuit 97 so long as it has an output capable of driving TTL and gates upon an input frequency in the range of 300 Hz to 1 KHz. In the illustrated embodiment, the circuit 97 comprises one pulse generating IC and one frequency dividing IC generating about 1 KHz pulse at all times.

The output is applied to the two-way switches 95 and 96 for selective application to terminals c of the stepping motors 93 and 81. Stepping motors 93 and 81 each have terminals a, b, c, d and e. The terminals d and e are connected to the power supply 94 while the terminals a, b and c ar control terminals for selectively causing the stepping motors 93 and 81 to be powered. The terminal a is effective to apply a half power input to the respective stepping motor for effectively reducing the power to prevent a temperature rise in the motor. The terminal b controls the direction of rotation of the stepping motors and when the signal at terminal b becomes 1, the stepping motors are turned in a counterclockwise direction. When the signal is shifted to 0, the stepping motors 93 and 81 are driven in a clockwise direction. The terminal c, as aforenoted, is a driving pulse input terminal and a driving output will be applied to the motor each time one pulse is added at the terminal c. The driving output of the motors 93 and 81 by one step is not achieved until a pulse is inputted at the terminal c.

The output ports P10 through P12 and P22 through P27 of the CPU 29 are normally maintained in a negative output in their normal, non-active state. Therefore, this output is raised up to the supply voltage by means of a resistance so as to prevent an erroneous signal unless an output is transmitted from the CPU 29 through the respective output port. The inverters Ia through Ii are employed for returning each output to the positive logical value.

When the output port P22 of CPU 29 becomes 0, a transfer gate of the two-way switch 95 is made equal to 1 and an output pulse of the pulse generating circuit 97 is applied to the terminal c of the stepping motor 93. Thus, an output for driving of the motor 93 is achieved. If, at this time, P23 of CPU 29 is 0, the input to terminal b of the stepping motor 93 causes the stepping motor to be driven clockwise so as to open the throttle under this condition. If, on the other hand, the output of P23 is 1, then the throttle will be driven by the stepping motor 93 in the opposite or closing direction.

On the other hand, if P22 becomes 1, the two-way switch 95 is turned off and a pulse is not fed to the terminal c of the stepping motor 93. In this case, the terminal c is kept at 0 and there is no output for driving the stepping motor 93. However, a current will be delivered to the terminal a of the stepping motor 93 which current is halved by an inverter Ij so that the power applied to the stepping motor 93 will be halved to avoid a temperature rise but to provide sufficient power to hold the throttle in its position.

The operation of the stepping motor 81 for achieving the shift operation is substantially the same as the operation for the stepping motor 93. When a pulse is not delivered to the terminal c by the two-way switch 96, the current applied to the terminal a will be halved by an inverter Ik so that the stepping motor 81 will be held in position. This holding is, however, achieved by a halved current so as to avoid overheating of the motor 81. When a pulse is generated by the switch 96 on the terminal c, however, the motor 81 will be driven in either the forward or reverse direction depending on the state of the terminal b as inputted from the CPU output port P25. When P25 is 0, the motor 81 runs clockwise and a shift will occur from either foward to neutral or neutral to reverse. When, however, P25 is 1, the motor 81 will run in a counterclockwise direction and the shift will be from reverse to neutral or neutral to forward.

The output ports P26 and P27 of the CPU 29 transmit their signals through the inverters Ie and If to a power amplifying IC 98 which, in turn, drives a pair of relays Rl and Rm. Relays Rl and Rm control respectively the tilt or trim up and tilt or trim down operation of the propulsion unit of the watercraft. Any known type of tilt/trim unit may be employed and controlled by the relays Rl and Rm. When the output of P26 becomes 0, an input is transmitted to the power amplifier 98 that becomes positive and the relay Rl is energized to effect tilt up operation. When, however, the output of P27 becomes 0, then the invert If inputs a 1 signal to the IC 98 and the relay Rm is energized so as to effect tilt down operation.

The output ports P10 through P12 of the CPU 29 input their signals through the inverters Ig, Ih and Ii to a power amplifying, integrated circuit 99. The integrating circuit 99, in turn, controls relays Rn, Ro and Rp. The port P10 and relay Rn control a kill switch for turning off the engine when the output port P10 becomes 0. This stops the engine from running.

When P11 becomes 0, the relay Ro is activated for operating the starter motor of the engine. When P12 becomes 0, the inverter Ii becomes 1 and the power amplifier 99 energizes the relay Rp to operate the choke of the carburetor 72 through an appropriate solenoid.

It should be noted that the electrical power source for the engine starting battery (12 volts) is provided through a transformer circuit and stepped down to 5 volts for controlling the CPUs 23 and 29. The transformer circuit and switch are not shown but are adapted to be embodied in the connection beween the CPU 29 and the optical fiber so that the power will be energized when the connector is connected. It should be understood that the power source can be connected to the CPU 23, however, if this is done, then a wire arrangement must be incorporated in connection with the optical cable 27 so as to transmit the power. As has been noted, the main switch 67 is provided for turning the power on to the system.

Figure 9:
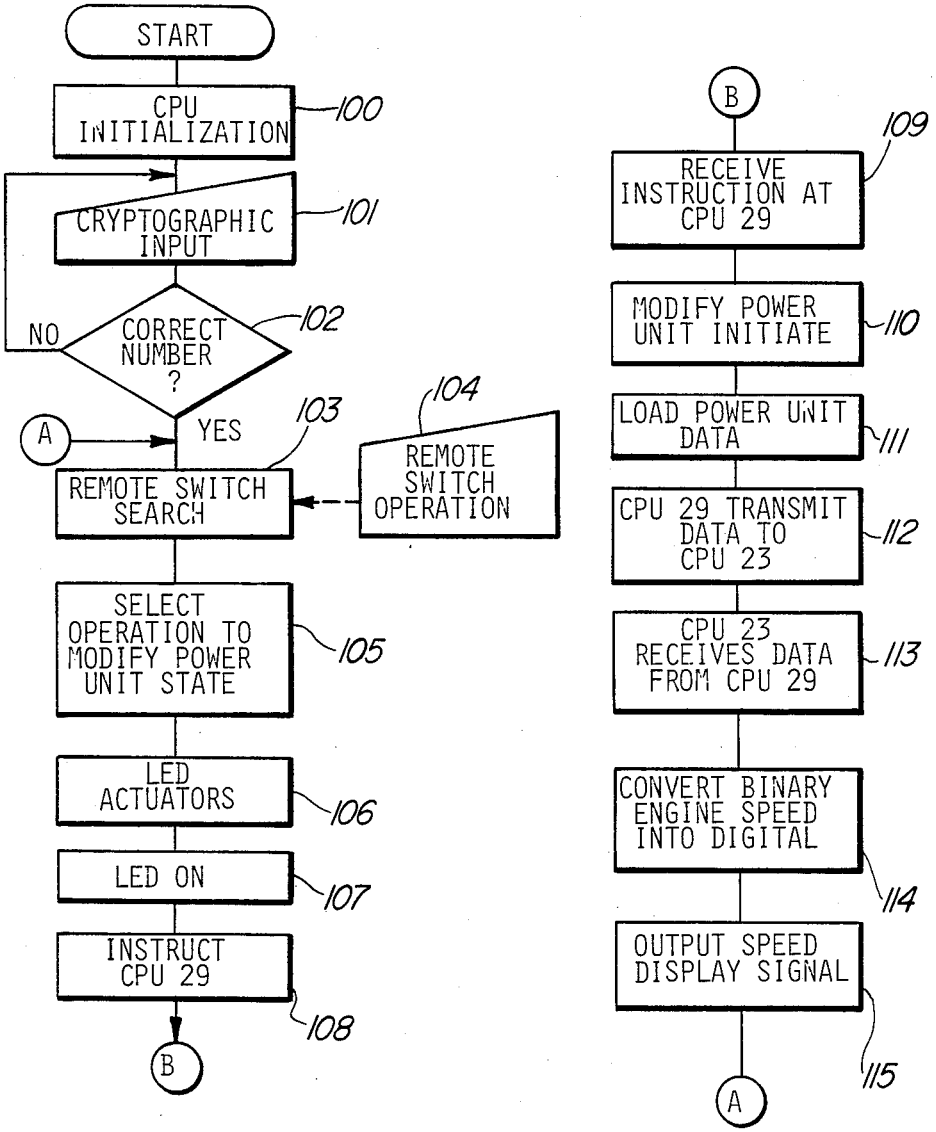
FIG. 9 is a block diagram of the general logic of the computer for initiating a control signal.

The basic logic system for controlling the power unit may be best understood by reference to the block diagram or flow chart of FIG. 9. This system covers the arrangement for controlling the watercraft power unit including the transmission and engine speed so as to accomplish, among other things as will be noted, acceleration of deceleration. This program also controls the basic initialization of the CPUs 23 and 29 upon start up.

When the power switch 67 of the control element 21 is turned on, the system starts and the CPU initialization begins at the block indicated 100. When the power is first supplied, the CPUs 23 and 29 operate in the same way to execute the initialization program stored in their ROM and RAM. By the use of such devices, the cost of the system can be reduced. When the switch 67 is turned on, power in the form of 5 volts is applied to the terminal TO of the CPUs 23 and 29.

When the CPU initialization step 100 begins, the engine state modifying operation instruction data and engine state information storage data are reset. Thus, no previously memorized values or states are retained.

The CPU 23 is then ready for inputting a cryptographic number by the operator at block 101 to determine if an authorized user is operating the system. The cryptographic identification of an authorized operator may be achieved in any of a number of ways and preferably it is achieved by a three number coded sequence. The numbers are entered by the operator depressing the appropriate key switches of the control element 21. The switches 57, 58, 59, 61, 62, 63, 65, 64 and 66 may be numbered 1 through 9 in sequence for this code. An initial code may be set by the factory or, alternatively, the user can change the cryptographic code as desired. The inputted code can be indicated on the LEDs when the operator presses the switches 57 through 61 and the CPU 23 will compare the operator input with the authorized setting to determine if an authorized operator is attempting to run the control system. This may be done by a erasible programmable memory EPROM in the CPU 23. If an operator attempting to utilize the system does not enter the correct cryptographic code after a certain number of attempts, the control element 23 may be designed so as to operate a warning signal.

Determination of the correct inputted cryptographic number is designated at the block 102. If the operator does not input the correct number, the system returns back to step number 101 so that the operator may again attempt to input a correct number. However, if the operator has inputted the correct number, the system moves on to the step 103 and the CPU 23 checks the state of the switches S1 through S12 to determine if any of them have been closed. The operator may achieve any desired change in state operation of the watercraft power unit at the block 104 by closing the appropriate desired switch 56 through 59, 61 through 66, inclusive. At the step 105, the CPU computes the newly acquired control date with the power unit status data that has been stored in the storage area and which has been sensed by the various sensors PS1 through PS6, OS1 through OS3 and PP1 of the controlled unit 28. At this time, the data in the storage is updated and memorized.

At the step 106, the LED display activating circuit is energized so as to condition the LEDs to display the appropriate date and engine state modifying instructions. This information is inputted to LDD1 to LDD3, DL1 or DL2 from the appropriate output terminals of the CPU 23 as aforedescribed. Then, in step 107, the appropriate LEDs are activated so as to indicate the power unit status and power unit status modifying instructions that have been inputted.

Simultaneously with the display of the appropriate LEDs occurring at step 107, the CPU 23 transmits instructions in accordance with its program to the CPU 29 to initiate the necessary operational step called for by the operator. This transmission is indicated by the block 108. Simultaneously at the CPU 29, the step 109 is executed which is the receipt of instructions from the CPU 23.

If the instructions are received, the CPU 29 executes the necessary steps at the block 110 to output, through its respective output ports P23 through P27 and P10 through P12, the necessary signals to modify the state of the power unit. Such modification may be either through actuation of the stepping motor 93 to advance or retard the throttle setting, the stepping motor 81 to shift the transmission or the relays Rl through Rp to either tilt up, tilt down, kill the ignition, starter operation or choke operation. The outputting signal is indicated by the block 110.

At the step 111, the CPU 29 accomplishes the loading of the observed status of the power unit including the number of engine revolutions, transmission position, choke status, over-rev indicator, over heat indicator, low oil level, throttle position, and ship speed. This information is received by and loaded into the CPU 29 from the sensors PS1 through PS6, OS1 through OS3 and MP1 and PP1. As previously noted, these inputs are transmitted to the CPU ports DB0 through DB7, P20, P21 and T1.

Once the sensor data is loaded at the step 111, it is transmitted from the CPU 29 to the CPU 23 at the step 112. The data transmitted to the CPU 23 is entered into its memory so as to update the information contained therein, as aforenoted.

Receipt of the data from the CPU 29 by the CPU 23 is indicated at the block 113.

The step 114 indicates the conversion by the CPU 29 of the binary engine speed information data from the circuit ID2 into a decimal information for display by the LEDs 38 of the control element 21. This display transmission step is indicated by the block 115.

It should be understood that the time of the routine from the step 103 to the step 115 is very short and the aforedescribed power unit control state modifying operation is carried out through a number of routines. At the completion of the step 115, the system returns to the step 103. The operation continues as long as the main power switch 67 is on.

Figure 10:
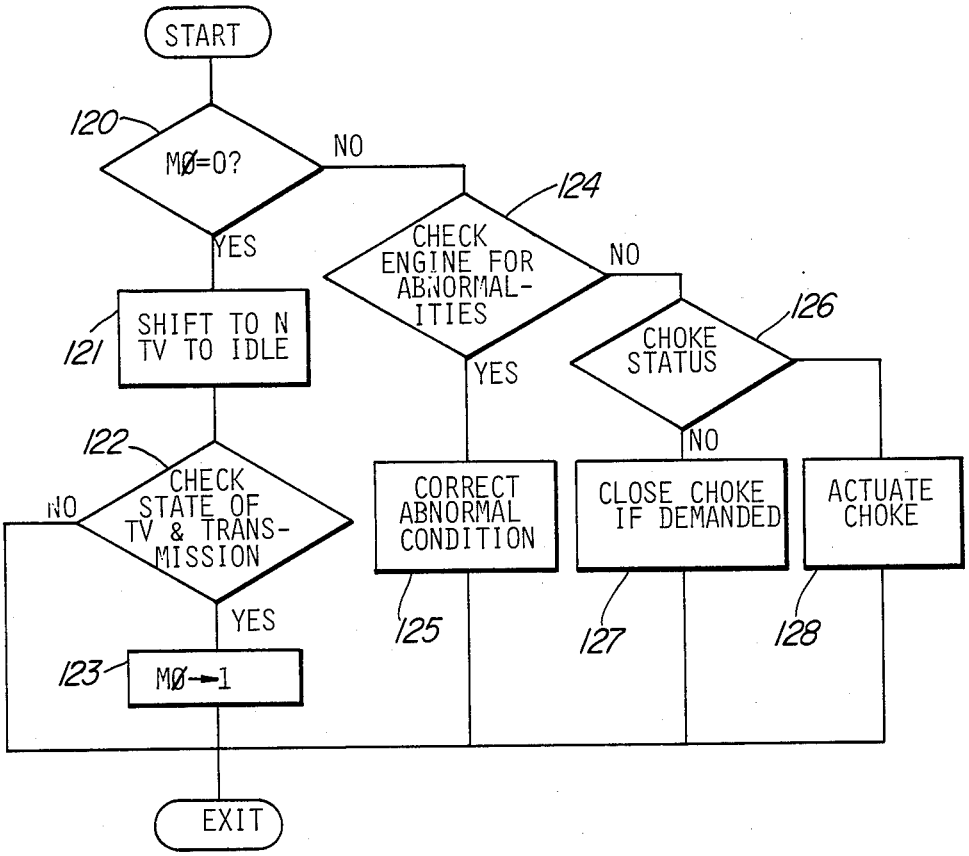
FIG. 10 is a block diagram showing the system for determining if the engine has been effectively started.

FIG. 10 is a flow chart indicating the program for selected power unit state modifying operations (step 105 of FIG. 9). At step 120, it is determined if a start up has been successful. At this state, the engine data is compared with a memorized data MC to determine if start up has been successfully accomplished. If it is found out that start up has been accomplished or during the time of actual start up, M $\phi=0$, the step 121 is performed. In the step 121, the transmission is shifted into neutral through operation of the stepping motor 81 and the throttle valve is returned to its idle position through operation of the stepping motor 93. The verification of the shifting of the transmission into neutral and the return of the carburetor throttle valve to idle is checked at the step 122 wherein these conditions are determined by determining if the switches PS1 and PS5 are closed. If the switches are closed, the data is modified to M $\phi=1$ in step in step 123.

If it is determined at the step 120 that M $\phi=1$ or start up has not been successfully completed, the status of the engine state sensors OS1 through OS3 is checked in step 124. At this step, if it is determined that any abnormal condition is indicated, the CPU 29 initiates corrective action at step 125.

If it is found at the step 124 that there are no engine abnormalities, the CPU 29 initiates a step 126 to determine if the choke is on or off. If the choke actuating solenoid Rp is not on, the CPU outputs a signal at 127 to close the choke valve if the control switch 64 of the control element 23 has been actuated. On the other hand, if it is determined at the step 126 that the choke status calls for choking operation, the computer outputs a signal at 128 so as to initiate choke opoeration.

Figure 11:
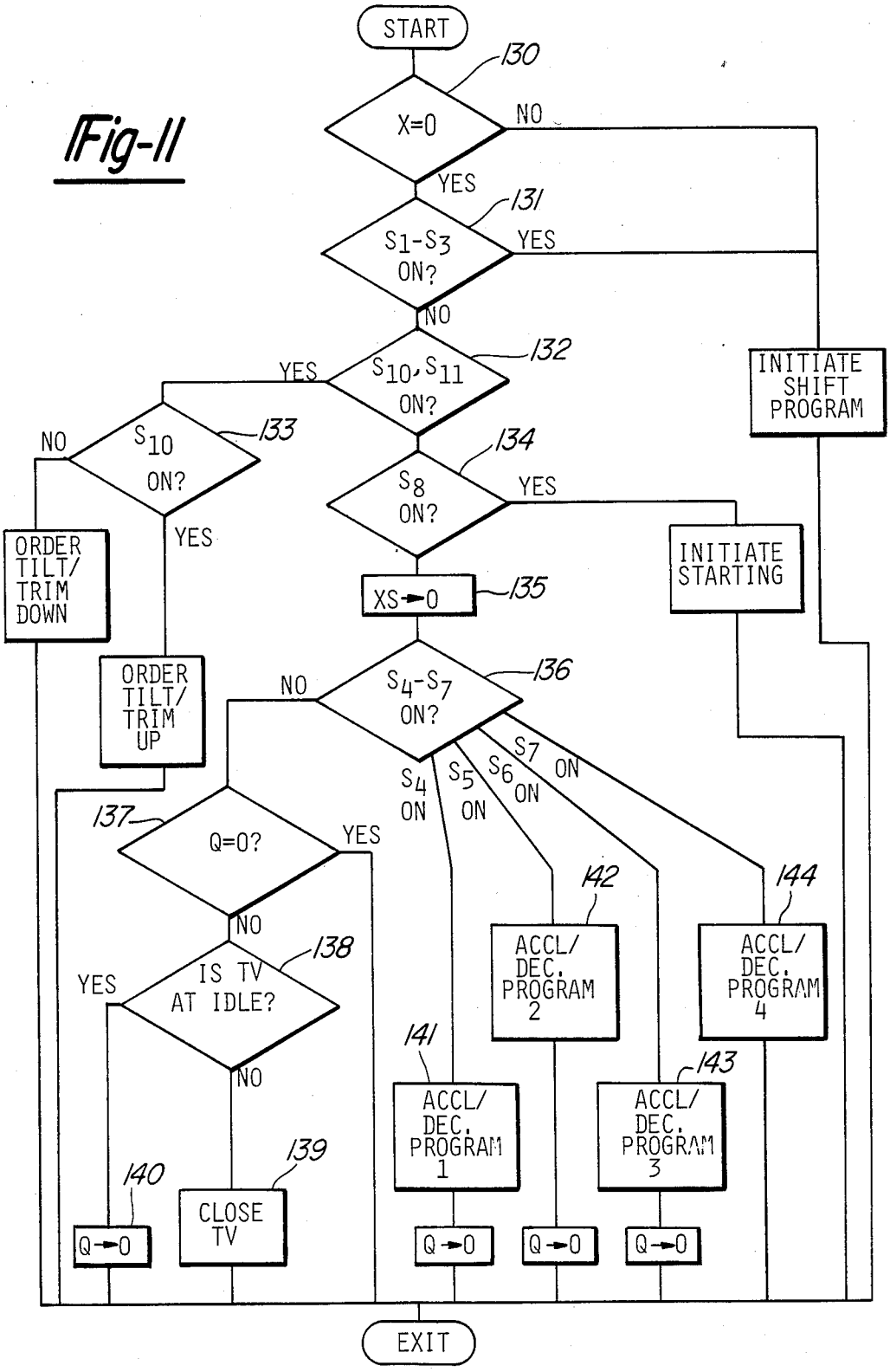
FIG. 11 is a block diagram showing the general logic for initiating the control functions.

FIG. 11 is a flow chart showing the programming of the CPU 23 in response to the conditions of all of the switches except for the choke switch (S1 through S8 and S10 through S12). At the start, the condition of the transmission control switches S1, S2 and S3 is first determined. There is provided in the memory of the CPU 23 an address code X that is indicative of whether a shifting operation has been called for by the actuation of any of the switches S1, S2 or S3. If the shifting has been completed, the number 0 is inserted into the memory. The numbers 1, 2 or 3 are inserted if either forward, neutral or reverse shifting has been called for through closure of the switches S1, S2 or S3, respectively. At the step 130 if the memory address code X is not 0 and one of the switches S1 through S3 has been actuated, a shifting operation is initiated in accordance with the shifting program, to be described in conjunction with FIG. 12.

If none of the switches S1 through S3 has been actuated or after the shifting operation has been completed, the CPLU 23 determines the status of switches S10 and S11 at step 132. This will determine if either tilt or trim up or tilt or trim down operation has been called for. At the step 133, it is determined if the switch S10 has been closed (turned on). If it has, the computer outputs a signal to initiate tilt or trim up operation. If the switch S10 has not been switched on, it is determined that the switch S11 has been turned on and tilt/trim down operation is ordered.

The status of the starting switch S8 is next determined at the step 134. If the starting switch S8 has been closed, the starting program is initiated by the CPU 23. XS is a state of the memory of the CPU 23 to indicate whether or not the starter has been operated. When starting has been completed, this memory is moved to the state 0 and thus if it is determined at the step 134 that starting has not been initiated or at step 135 that the starting operation is completed, the computer moves to the step 136.

In step 136, the computer determines whether any of the switches S4 through S7 have been actuated so as to initiate one of the acceleration/deceleration programs 1-4 as will be described in connection with FIGS. 13-16. If none of the switches S1 through S4 are indicated as being on at the step 136, the computer moves to the step 137 to determine the throttle valve position if a shift to reverse for emergency deceleration has occurred (FIG. 16) and the switch 67 were turned off. The computer is provided with a memory and an address code Q which is equal to 0 if this condition has occurred. If not, the memory Q is placed at 1. Therefore, if it is determined at the step 137 that the throttle is in its idle position due to the aforenoted condition, the program is exited.

At the step 137, it is determined that the throttle position is not closed as indicated previously by the position of the throttle sensor, then the throttle position is again checked to determine if it is actually at its idle position at the step 138. If it is determined at the step 138 that the throttle valve is in fact in its idle position, the status of the memory Q is updated to 0 at the step 140 and the program is exited. If, however, it is determined at the step 138 that the throttle valve is not in its idle position, initiation of throttle valve closing is done at the step 139.

It is determined at the step 136 that one of the switches S4 through S7 is turned on, then the CPU 23 initiates an operation at either the steps 141, 142, 143, or 144 to effect one of the acceleration/deceleration programs 1-4. The acceleration/deceleration program will be described in conjunction with the description of FIGS. 13 through 16. At the completion of the respective acceleration/deceleration program in the steps 141, 142 and 143, a process for changing the memory Q to 0 is performed. The reason for this is that whether or not the throttle has been closed to its idle position is irrelevant after any of these operations. Thus, the operational switch may be turned off at the completion of the operation.

In essence, a purpose of step 137 is to exit the program if it is determined that none of the switches S1–S8 and S10 and S11 have been switched on. Also, the CPU is programmed not to initiate a control function in the event a plurality of conflicting switches have been actuated (turned on). For example, if a plurality of switches S1–S3 or S4–S7 or S10 and S11 are turned on, no control function will be executed.

The shift program will now be described by reference to FIG. 12. Basically, the purpose of the shift program is to compare the operator selected transmission shift (condition of S1–S3) with the actual state of the transmission (condition of PS4–PS6) and to initiate a shift if the transmission is not in the operator's selected mode. However, before the shift occurs, the engine speed is reduced so as to make sure that there will be no damage to the transmission.

Figure 12:
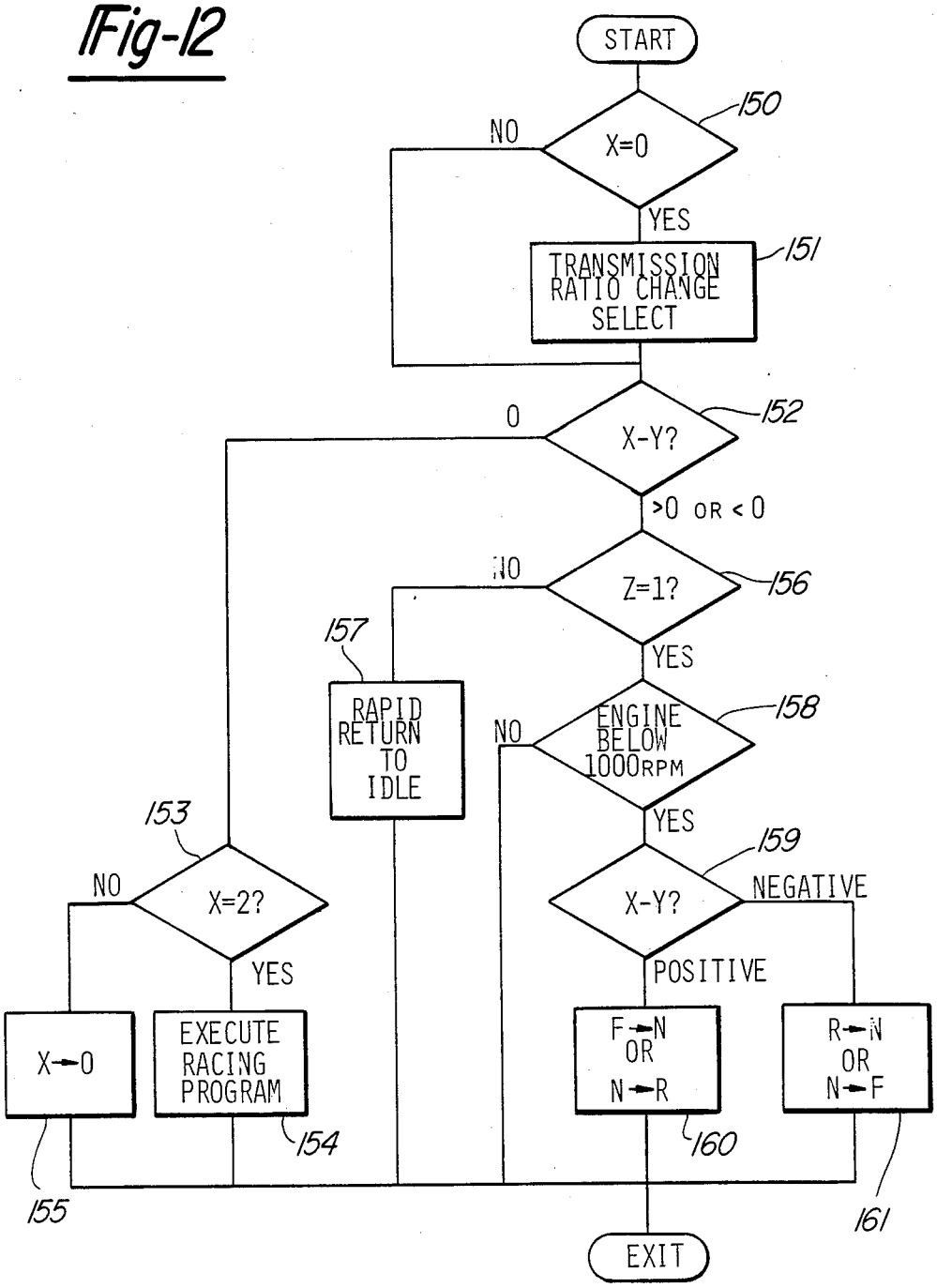
FIG. 12 is a block diagram showing the logic of the shifting program.

Referring now specifically to FIG. 12, the CPU 23 has the aforenoted memory with a X register for indicating the selected transmission mode change, a Y register for indicating the actual transmission position and a Z register for indicating throttle valve position. With respect to the transmission registers X and Y, 1=forward, 2=neutral and 3=reverse. With respect to the throttle valve register Z, 1=idle, 2=part throttle and 3=full throttle.

When the program starts, it is first discriminated at step 150 if there has been an operator control input to one of the switches 59, 61 and 62 (S1–S3). If there has, this input is inserted at step 151 in the X register to indicate which transmission ratio the operator has selected. The selected ratio is then compared with the actual state of the transmission at the step 152 when the X register has subtracted from it the Y register.

If X minus Y=0, the program moves to the step 153 where it is determined if the transmission is in neutral. If the transmission is not in neutral, the system moves to the step 155 where the value of X in the register is returned to 0 and the program is exited. If, however, the transmission is in neutral and the X register is equal to 2, a throttle racing step is carried out at 154. This is done to insure quick warm up on starting.

If at step 152 it has been determined that the actual transmission ratio is not equal to the position in which the transmission is selected (X minus Y is not equal to 0), then the program proceeds to the step 156. In the step 156 it is determined if the throttle valve is in its idle position (Z=1). The reason for this is that if a shifting operation is to be accomplished, the throttle must be moved to its idle position and the engine speed reduced before shifting will occur. If the throttle position sensor is not in the condition such that PS1 is on, a program will be initiated at step 157 to rapidly return the engine to idle.

If, however, it is determined at the step 156 that a transmission ratio change is required and that the throttle valve position sensor PS1 is closed so that Z=1, at step 158 the actual speed is determined. If it is determined that the engine speed is below 1,000 RPM, the difference between the X address and the Y address is computed at step 159. If the value is positive, then it is known that the transmission must be moved from the forward speed to a reverse speed and at step 160, a signal is output to the stepping motor 81 to move it into either neutral from forward or reverse from neutral. If, however, the result is negative, it is determined that a shift must be made from reverse to neutral or neutral to forward and the stepping motor 81 is activated so as to accomplish a shift in this direction.

If it has been determined that the speed of the engine has not fallen below 1,000 RPM at the step 158, the program is exited and repeated until the engine speed has fallen so that shifting will not occur before the engine speed is below 1,000 RPM.

Figure 13:
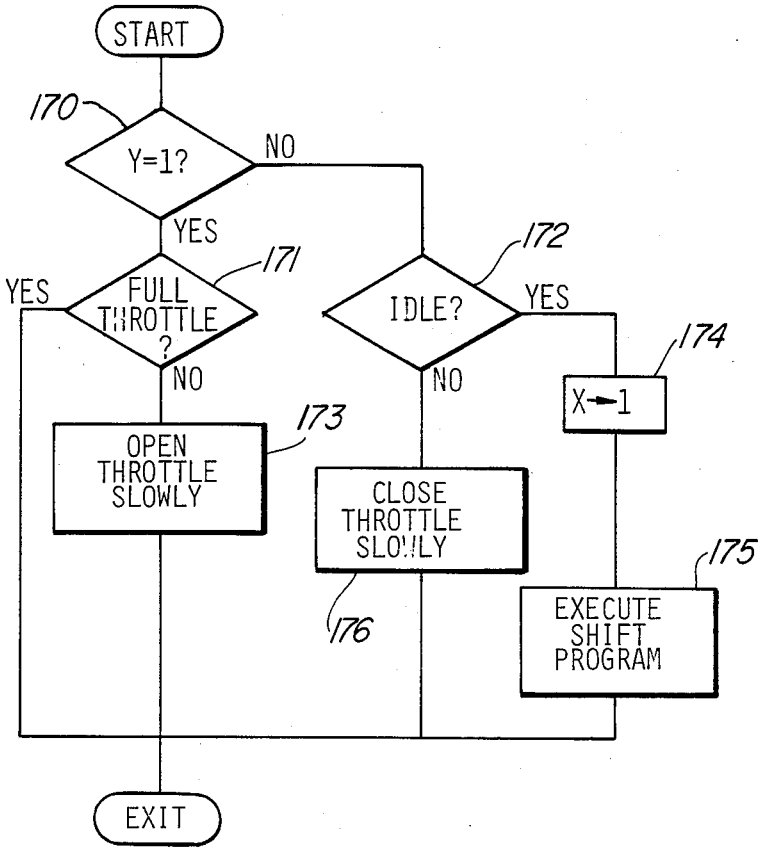
FIG. 13 is a block diagram showing one of the acceleration/deceleration programs, particularly slow acceleration in either forward or reverse.

Turning now to FIG. 13, the logic for accomplishing one of the acceleration/deceleration programs, either slow acceleration in forward gear or slow deceleration in reverse (program No. 1), is depicted. These operations are initialized by the operator pushing switch 57 softly (S4) with the transmission in forward or reverse, respectively. After initiation of the program and at step 170, the condition of the transmission selector is noted. If Y=1 (forward), the system moves to step 171 and determines if the throttle valve is in its full throttle position through the closure of the switch PS3. If the switch PS3 is closed, the system exits since no further acceleration is possible. If, however, the switch PS3 is not closed indicating less than full opening of the throttle valve, then the CPU 23 outputs a signal to the CPU 29 for activating the stepping motor 93 at a slow pulse for gradually opening the throttle valve. As has been previously noted, this throttle valve opening continues as long as the switch 57 is slightly pressed.

If, on the other hand, it is determined at the step 170 that the transmission is not in a forward gear, then step 172 is carried out. At the step 172 it is determined if the throttle valve of the carburetor is in its closed position by determining if the switch PS1 is closed. If it is not closed, then the system moves to the step 175 for outputting a signal to the stepping motor 91 for causing the throttle valve to be closed at a slow rate. If, however, it is determined at the step 172 that the carburetor throttle valve is closed, then at the step 174, this is input into the X register and the shifting program is executed for shifting the transmission from reverse to neutral and then to forward at step 175.

Figure 14:
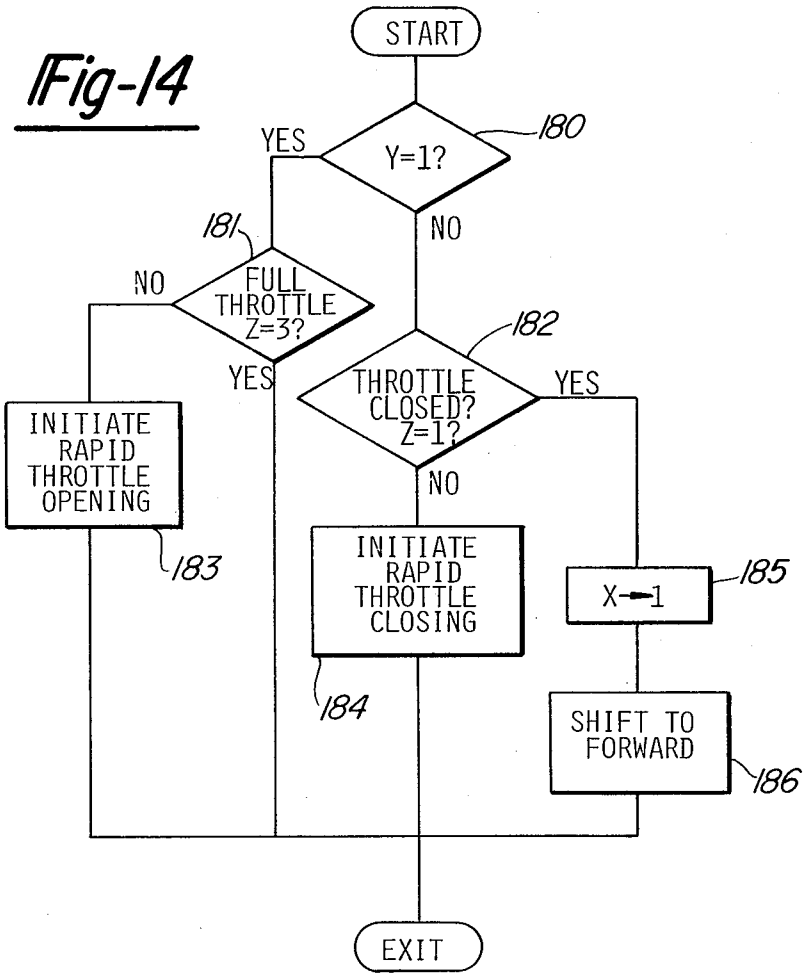
FIG. 14 is a block diagram showing another of the engine speed change programs and specifically a system for providing rapid acceleration in forward gear and emergency deceleration in reverse.

Referring now to FIG. 14, another acceleration/deceleration program (No. 2), that for fast acceleration in forward gear or fast deceleration in reverse gear, is depicted. Upon the hard pressing of the acceleration button 57, switch S5 of the CPU is closed, as has been previously noted, and the program is started at step 180 to determine the state of the transmission. If the transmission is in forward gear (Y=1), then the program moves to step 181 to determine the status of the throttle valve position. If the throttle valve is determined to be in the full throttle position Z=3 (PS3 closed), then the program is exited since further acceleration is obviously not possible. If, on the other hand, the throttle is determined as not being fully open at step 181, the computer moves to step 183 so as to output a signal to the stepping motor 91 for executing rapid throttle opening.

If it is determined at the step 180 that the transmission is not in forward gear, then the CPU moves to the step 182 to determine if the throttle valve is in its closed position so as to initiate a shift into forward gear. If the throttle valve is not fully closed (Z not equal to 1, switch PS1 not closed), then the program moves to step 184 initiating rapid closing of the throttle valve.

Once the throttle valve has been rapidly closed or if the throttle valve is already determined as being closed at the step 182, the system moves to the step 185 so as to input a forward transmission select mode at step 185 (X=1). Then, at step 186, the shifting program is initiated for shifting into forward gear.

Figure 15:
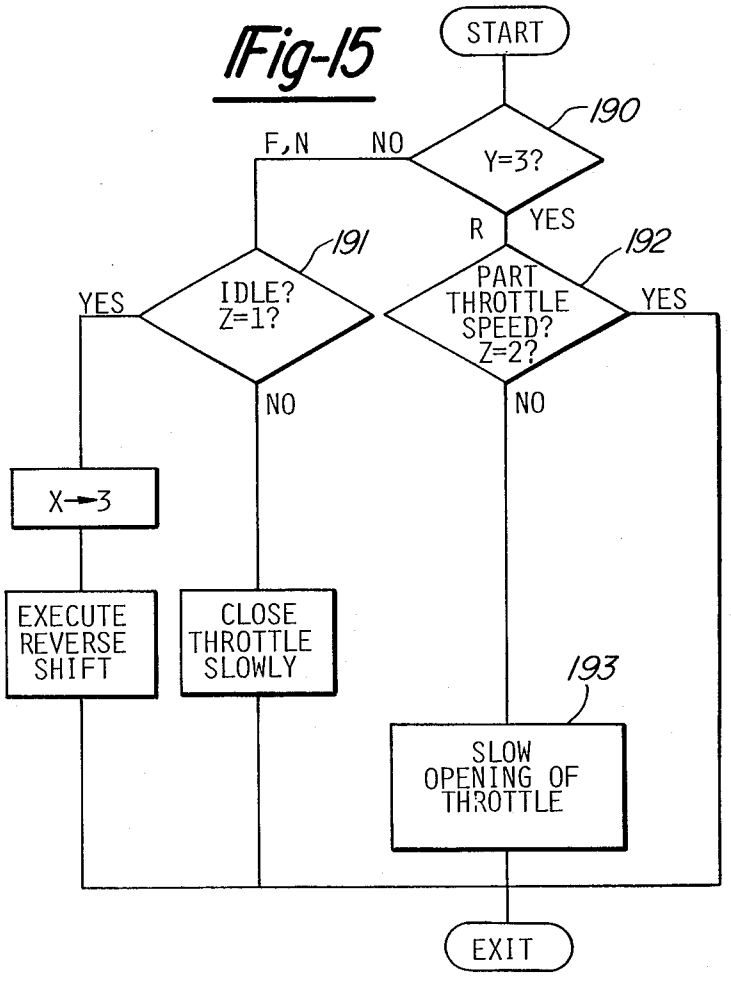
FIG. 15 is a block diagram for another of the acceleration/deceleration programs, specifically slow forward or slow rearward deceleration.

Referring now to FIG. 15, this shows the flow chart for the acceleration/deceleration program No. 3, specifically slow forward deceleration or slow rearward acceleration. This program is initiated by soft pushing of the switch 58. In this program, it is initially determined at the step 190 if the transmission is in reverse (Y=3). As has been previously noted, this is determined by the condition of the switch PS6. If PS6 is not closed, it is then determined that the transmission is in either forward or neutral and the program moves to the step 191. In the step 191, the throttle valve position is determined and it is tested to see if the throttle valve is in its closed (idle) position (Z=1, PS1 closed). When the throttle valve is in its idle or closed position, the computer changes the state of the register X to 3 for initiating a reverse shifting program. This is done for slowing the speed of the watercraft by shifting into reverse.

If, on the other hand, the throttle valve is determined not to be in the idle position at the step 191, the CPU outputs a signal to the stepping motor 93 for causing slow closure of the throttle valve.

If it is determined at the step 190 that the transmission is in reverse and thus acceleration has been called for, it is determined at the step 192 if the throttle valve is in its part throttle condition (PS2). It should be noted that the computer program is such that the speed of the engine is not permitted to exceed part throttle when in reverse gear. If it is determined that the throttle valve is in its part throttle condition, the program is exited since further engine speed is not permitted. If not, the program moves to the step 193 for energizing the stepping motor 93 in such a way as to cause slow opening of the throttle valve until it reaches its part throttle position.

Figure 16:
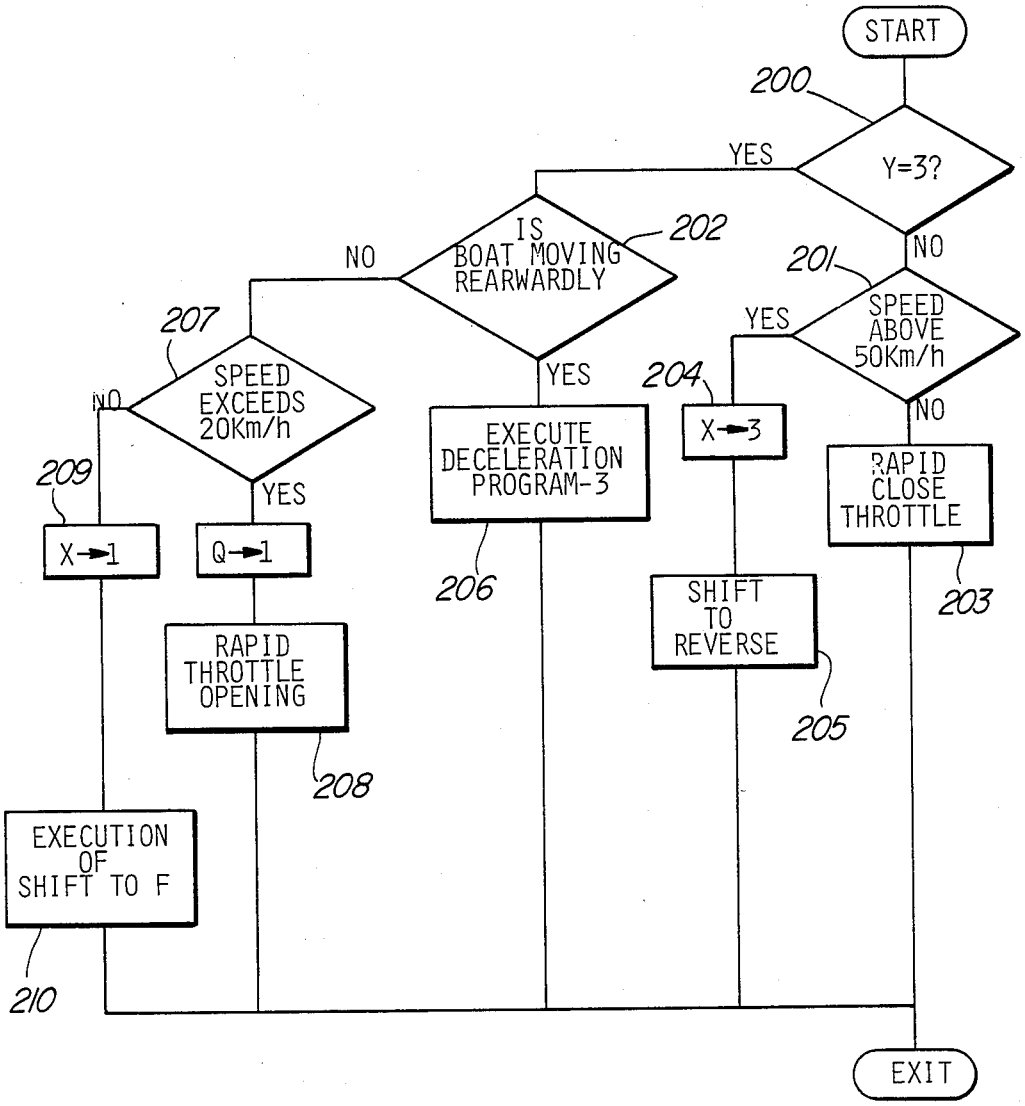
FIG. 16 is a block diagram of another of the acceleration/deceleration programs and specifically emergency deceleration in forward gear.

FIG. 16 shows the logic for acceleration/deceleration program No. 4, namely, emergency forward deceleration or emergency rearward deceleration. The program is initiated by pusning switch 58 hard. The logic of this program is operative to effect slowing of the watercraft by rapidly closing the throttle and/or shifting the transmission into the opposite direction so as to cause a rapid slowing. If the transmission is in a forward gear and a rapid deceleration is called for and the boat is travelling above a predetermined speed as sensed by the ship speed sensor PP1, such as 50 kilometers per hour, the slowing is accomplished by shifting the transmission into reverse. If, however, the boat speed is less than 50 kilometers per hour in a forward direction, then the boat is slowed by rapidly closing the throttle valve. If, however, the transmission is in reverse gear and the boat is not travelling backward, then the boat is rapidly changed in direction either by shifting into forward or by opening the throttle valve at a rapid speed depending on whether or not the boat speed is over a predetermined value (in this case 20 kilometers per hour). If, however, the boat is traveling backward, then the deceleration program 3 is followed.

Referring now specifically to FIG. 16, the first step 200 is to determine the status of the transmission. If the transmission indicator indicates that the transmission is in reverse (PS6 closed, Y=3), then the step 202 is executed to determine if the boat is traveling forwardly or rearwardly. If the boat is traveling rearwardly, then at block 206 the deceleration program according to program No. 3 is initiated. If, however, the boat is not traveling rearwardly, then the rate of forward motion is determined at the step 207. If the speed does not exceed 20 kilometers per hour, then at the step 209, the value of 1 is inputted into the memory for X and the shifting program is executed at the step 210. This is done to return the transmission to forward gear.

If, howver, at the step 207 it is determined that the speed of the boat is above 20 kilometers per hour in the forward direction, then the value of 1 is inputted at Q and a rapid throttle opening operation is outputted at step 208.

Returning now to the condition if it is determined at step 200 that the transmission is not in reverse (Y=3), then the vehicle speed in a forward direction is sensed at step 201. If the speed is above a predetermined speed (50 kilometers per hour in the depicted example), then the program moves to step 204 and shifting into reverse according to the shifting program is initiated at step 205. If, however, the speed is less than 50 kilometers per hour in the forward direction, then at step 203 the boat speed is reduced by rapid closing of the throttle valve.

Figure 17:
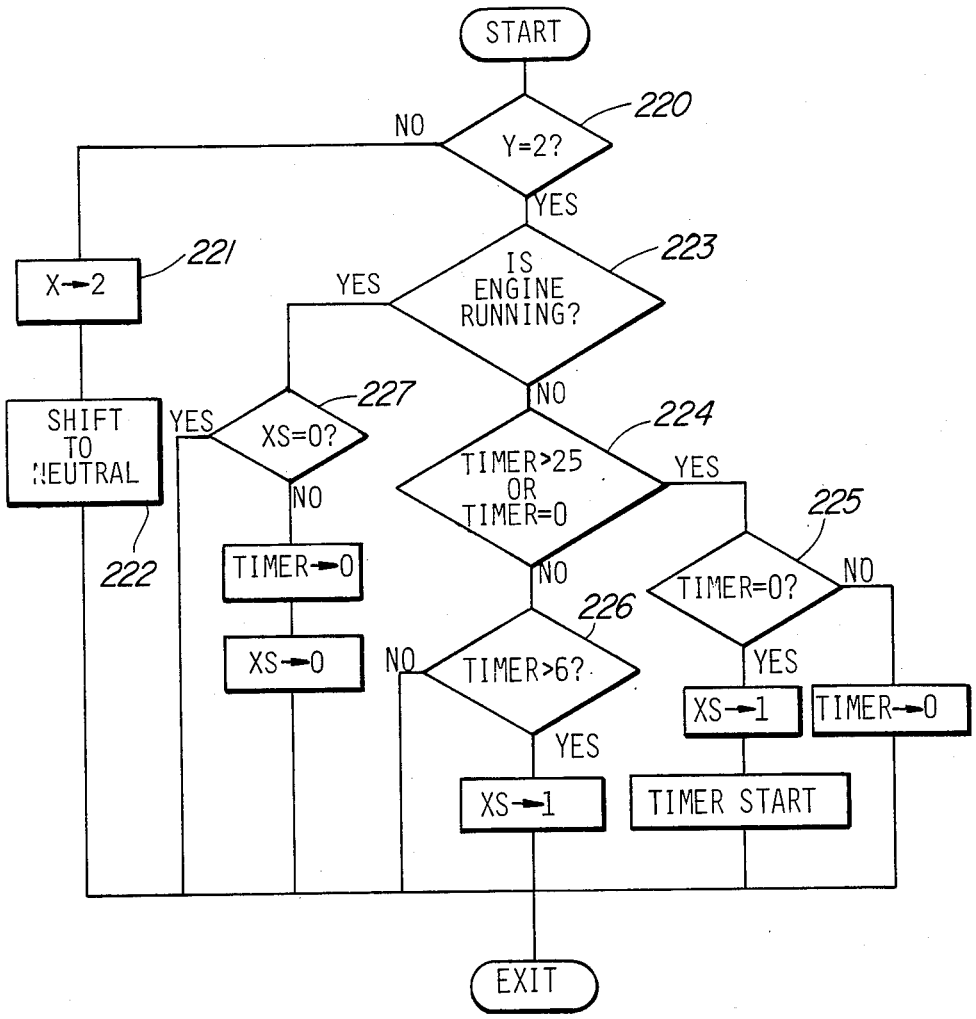
FIG. 17 is a block diagram indicating the engine starting program.

The starting program is depicted in FIG. 17 and is initiated upon the operator pushing of the starter button 63. Basically, the logic for the starting program is to insure that the transmission is in neutral before starting is initated and to run the starter motor no more than six seconds so as to prevent overheating and damage to it. Also, a cool-down period is incorporated so that successive operations of the starter motor do not occur too frequently.

Referring now specifically to FIG. 17, the starter switch 63 is pressed, the computer moves to step 220 to determine if the transmission is in neutral (Y=2, PS5 closed). If the transmission is not in neutral, the CPU 23 initiates a shifting step at step 221 by setting X equal to 2 and then the transmission is shifted into neutral at block 222 in accordance with the shifting program already described.

Once the transmission is in neutral, the computer determines at step 223 if the engine is running at a speed that indicates that it has been started. This speed is a speed that is less than idle speed but greater than cranking speed. In the illustrated embodiment, such a speed may be 400 RPM.

If it is determined at the step 223 that the engine is not running, the status of a timer (XS) in the starting motor circuit is checked at step 224. At this step, it is determined whether the timer is set for over 25 seconds or at a value equal to 0. The time of 25 seconds is set so that the starter will be permitted some time to cool down between successive operations. If the result at the step 224 are positive, it is then determined at the step 225 if the timer is set at 0. If it is not, the timer is reset to 0. If, however, the timer is set at 0, the starting operation is initiated by setting XS equal to 1. At the same time, the timer is started to run.

The program then goes back to the step 223 to determine if the engine is running. If the engine is not running, the timer is again checked at step 226 and if it has run more than 6 seconds, the starting initiation is stopped by resetting XS to 0. The reason for this is to insure against damage to the starter by continuous operation.

If it is determined at the step 223 that the engine is running because its speed is over 400 RPM, the program moves to the step 227 wherein the status of the timer is determined. If the timer is at 0, the program is exited. If it is not, the timer is set to 0 and the starting operation is reset to 0 so that the starting operation will be discontinued.

It should be readily apparent from the foregoing description that a highly effective system is provided for transferring control signals in a watercraft from a control element to a controlled element. By using fiber optics and a multiplexing system for transmitting the signals, the likelihood of false actuation of the boat throttle, starter, choke, transmission and similar controls due to extraneous noise is avoided. Also, the use of fiber optics avoids the possibilities of damage or false signals being transmitted as might happen if water permeates electrical connectors, which is a distinct possibility in watercraft. In addition, it is insured that the watercraft control is effectively transmitted and under emergency conditions, the watercraft can be slowed rapidly either by rapid closing of the throttle valve and/or by shifting of the transmission into the opposite direction from which the watercraft is traveling. In addition, the starting mechanism for the watercraft is such that starting is insured and, in the event of some failure to start, the system self checks itself and also insures that the starter motor will not be cranked for long periods of time, even though the operator may continue to hold the starter button in its on position.

It is also to be understood that the foregoing description is only that of a preferred embodiment of the invention and that various changes and modifications may be made without departing from the spirit and scope of the invention, as defined by the appended claims.

We claim:

1. In a remote control system for a watercraft having a propulsion unit comprised of an engine having an engine speed control, and a transmission having at least a forward gear and a neutral, first power means for moving said engine speed control between an idle position, a part throttle position and a full throttle position, second power means for moving said transmission between said forward gear and said neutral condition, a remote control device for actuating said first and said second power means including an operator actuable engine speed control element and an operator actuable transmission control element and computer means for transmitting signals from aid remote control device to said first and said second power means including logic for precluding operation of said second power means to effect a shift unless the engine speed is below a predetermined value.

2. In a remote control system as set forth in claim 1 wherein the precluding of the operation of the second power means until the engine speed is below a predetermined amount includes means for actuating the first power means to return the engine speed control to its idle condition in response to operation of the transmission control element.

3. In a remote control system as set forth in claim 2 further including means for sensing engine speed and the computer means precludes operation of the second power means until the first power means has moved the engine speed control to its idle condition and the engine speed is actually below a predetermined amount.

4. In a remote control system as set forth in claim 1 wherein the transmission further includes a reverse gear and the computer means is effective to prevent a shift between any gears unless the engine speed is below the predetermined amount.

5. In a remote control system as set forth in claim 4 wherein the computer means further includes means for precluding full throttle operation of the engine in reverse gear when the engine speed control element is operated.

6. In a remote control system as set forth in claim 5 wherein the precluding of the operation of the second power means until the engine speed is below a predetermined amount includes means for actuating the first power means to return the engine speed control to its idle condition.

7. In a remote control system as set forth in claim 6 further including means for sensing engine speed and the computer means precludes operation of the second power means until the first power means has moved the engine speed control to its idle condition and the engine speed is actually below a predetermined amount.

8. In a remote control system as set forth in claim 1 wherein the first and second power means comprise stepping motors.

9. In a remote control system as set forth in claim 1 wherein the computer means is effective to rapidly slow the engine speed control in response to an emergency slow down condition.

10. In a remote control system as set forth in claim 9 wherein the computer means is further operative to shift the transmission into an opposite direction in the event of an emergency slow down condition.

11. In a remote control system for a watercraft having a propulsion unit comprising an engine having an engine speed control and a transmission having at least a forward gear, a reverse gear and a neutral, first power means for moving said engine speed control between an idle position, a part throttle position and a full throttle position, second power means for moving said transmission between said forward gear, said neutral and said reverse gear conditions, a remote control device for activating said first and second power means, and computer means for transmitting signals from said remote control device to said first and second power means including logic for precluding said first power means from moving said engine speed control past the part throttle position when the transmission is in a predetermined one of its conditions.

12. In a remote control system as set forth in claim 11 wherein the engine speed is limited in reverse.

13. In a remote control system for a watercraft having a propulsion unit comprising an engine having an engine speed control and a transmission having at least a forward gear, a reverse gear and a neutral, first power means for moving said engine speed control between an idle position, a part throttle position and a full throttle position, second power means for moving said transmission between said forward gear, said neutral and said reverse gear conditions, a remote control device for activating said first and second power means, and computer means for transmitting signals from said remote control device to said first and second power means including logic for rapidly reducing the throttle valve position and shifting the transmission from one of its positions through neutral to the other of its positions in response to an emergency deceleration signal.

14. In a remote control system as set forth in claim 13 wherein the logic means further is effective to only cause slowing of the watercraft by reducing the engine speed when the watercraft speed is below a predetermined speed.

15. In a remote control system for a watercraft having a propulsion unit comprised of an engine having an engine speed control, and a transmission having at least a forward gear, a reverse gear, and a neutral, first power means for moving said engine speed control between an idle position, a part throttle position and a full throttle position, second power means for moving said transmission between said forward gear and said neutral condition, a remote control device for actuating said first and said second power means and computer means for transmitting signals from said remote control device for actuating said first and second power means including logic for precluding operation of said second power means to effect a shift into any gear unless the engine speed is below a predetermined value, said computer means further including means for precluding full throttle operation of the engine in reverse gear.

16. In a remote control system as set forth claim 15 wherein the precluding of the operation of the second power means until the engine speed is below a predetermined amount includes means for actuating the first power means to return the engine speed control to its idle condition.

17. In a remote control system as set forth in claim 16 further including means for sensing engine speed and the computer means precludes operation of the second power means until the first power means has moved the engine speed control to its idle condition and the engine speed is below a predetermined amount.

18. In a remote control system for a watercraft having a propulsion unit comprised of an engine having an engine speed control and a transmission having at least a forward gear and a neutral, first power means for moving said engine speed control between an idle position, a part throttle position and full throttle position, a second power means for moving said transmission between said forward gear and said neutral condition, a remote control device for actuating said first and said second power means and a computer means for transmitting signals from said remote control device to said first and said second power means including logic for precluding operation of said second power means to effect a shift unless the engine speed is below a predetermined value, said computer means being ineffective to rapidly slow the engine speed control in response to on emergency slow down condition.

19. In a remote control system as set forth in claim 18 wherein the computer means is further operative to shift the transmission into an opposite direction in the event of an emergency slow down condition.

* * * * *